US006514041B1

(12) United States Patent
Matheny et al.

(10) Patent No.: US 6,514,041 B1
(45) Date of Patent: Feb. 4, 2003

(54) CARRIER FOR GUIDE VANE AND HEAT SHIELD SEGMENT

(75) Inventors: Alfred Paul Matheny, Jupiter, FL (US); Alexander Beeck, Orlando, FL (US)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 09/949,636

(22) Filed: Sep. 12, 2001

(51) Int. Cl.[7] ..... F01D 5/08

(52) U.S. Cl. ..... 415/177; 415/191; 415/208.2; 415/211.2

(58) Field of Search ..... 415/177, 191, 415/208.2, 173.1, 178, 211.2

(56) References Cited

U.S. PATENT DOCUMENTS

| | | | | |
|---|---|---|---|---|
| 3,736,069 A | * | 5/1973 | Beam, Jr. et al. | 415/115 |
| 4,920,742 A | * | 5/1990 | Nash et al. | 60/39.32 |
| 5,165,848 A | * | 11/1992 | Plemmons | 415/177 |
| 5,380,150 A | | 1/1995 | Stahl | |
| 5,927,942 A | | 7/1999 | Stahl et al. | |

FOREIGN PATENT DOCUMENTS

| | | |
|---|---|---|
| DE | 1 057 827 | 5/1959 |
| DE | 43 09 199 | 9/1994 |

* cited by examiner

*Primary Examiner*—Edward K. Look
*Assistant Examiner*—Ninh Nguyen
(74) *Attorney, Agent, or Firm*—Burns, Doane, Swecker & Mathis, L.L.P.

(57) ABSTRACT

A thermal turbo machine is provided for the attachment of guide vanes on its stationary housing with guide vane carriers with a guide vane platform, from which braces extend towards a band that is suspended in a recess in the stationary housing. In particular, part of the axially adjoining heat shield segments form part of the guide vane platform, and the braces are arranged in a V shape. The braces and the guide vane platform furthermore include a first material, and the band of a second material, whereby the first material has a higher coefficient of expansion than the second material. The guide vane carrier according to the invention has the advantage that the radial blade clearance for the guide vanes and at the same time the radial blade clearance for the rotating blades is minimized for different operating conditions of the turbo machine.

24 Claims, 8 Drawing Sheets

CARRIER FOR GUIDE VANE AND HEAT SHIELD SEGMENT

FIELD OF THE INVENTION

The invention relates to a carrier for a guide vane and a heat protection shield for a guide vane in a thermal turbo machine, such as, for example, a turbine part or compressor of a gas turbine, in order to achieve minimal radial vane play.

BACKGROUND OF THE INVENTION

In thermal turbo machines, radial vane clearance(a) exists between the rotating vanes and stationary housing, as well as between guide vanes and rotor. This vane clearance is determined during operation by mechanical and thermal movement of the various machine parts. In the process, different vane clearance are created during the various operating conditions, such as, for example, during start-up and shut-down, constant performance operation, and load changes, because the vanes, housing and rotor expand and contract differently. If the vane clearance is made sufficiently large to prevent a rubbing of the machine parts in all operating situations, this will provide an undesired, large vane clearance in certain operating conditions that will cause a reduction in the performance of the gas turbine or pumping limit of a compressor.

Previous attempts to decrease vane clearance and thereby increase the performance of the turbo machine always included efforts to maintain the level of production costs and life span of the machine. In order to limit the expansion of the stationary housing, this included, for example, the forced cooling of the stationary housing or materials with low coefficients of expansion.

DE 1 057 827 describes a vane wheel rim with a groove facing the rotating vane tips. Into the groove are inserted heat-resistant and abradable sealing elements consisting of a thermically designed expansion body whose mass distribution, clamping and positioning is such that the vane clearance is maintained approximately constant during temperature changes. This is achieved, for example, by a curvature of the sealing element in an axial direction, whereby the curvature changes during cooling or heating in such a way that a small gap is maintained. On the other hand, a small gap is achieved in that the abradable surfaces rest against the guide vane tips during the installation of the sealing elements and abradable off when the machine starts up. The abradable also achieves the smallest gap possible and prevents a breaking of the vane tips.

DE 43 09 199 describes a device for attaching heat shield segments and guide vanes in turbines with an axial flow. Here, the heat shield segments are attached to a massive stator ring that is inserted into recesses in the exterior housing of the turbine. The guide vanes are thereby attached, separately from the heat shield segments, directly to the exterior housing. The massive stator rings are sized relatively small so that their temperature and the vane play between the massive stator ring and vane tips can be better controlled. The temperature of the massive stator ring can also be controlled with cooling by air or fluids or by electrically heating, so that the vane plays can be controlled.

U.S. Pat. No. 5,927,942 and U.S. Pat. No. 5,380,150 describe a heat shield segment in a gas turbine that is attached radially opposite from the rotating vane tips on the stationary housing. Each heat shield segment consists of a substrate with a abradable layer. It is connected radially and axially on both sides as well as in the center of the heat shield segment by means of rails that have a hook-shaped cross-section to a carrier unit on the housing of a turbine machine, whereby the hooks are provided in recesses in the carrier unit. A segmented, spring-loaded band furthermore extends between the hooks on both sides of the heat shield segment. The band permits, in particular, a springing attachment of the heat shield segment at the carrier unit, thus absorbing any instances of thermal expansion and deformation of the heat shield segment and carrier unit. This attachment enables a radial as well as axial movement of the heat shield segment, whereby the rail in the center of the heat shield segment prevents a radial inward movement. The segmented band furthermore ensures a seal that prevents the coolant from flowing out of the space between the heat shield segment and the segmented band. And finally, the heat shield segment has a abradable layer for minimizing the rotating vane play.

The disadvantage of the heat shield segment or heat protection shield according to the described state of the art is, on the one hand, the abradable layers. In most machines, for example in gas turbines, the worn-off material remains inside the machine housing in the form of particles and may damage surfaces and obstruct cooling channels. The vane play created in this way does not necessarily have the optimally small size. When the turbo machine is started, the rotor first expands, while the housing of the turbo machine expands more slowly. If the abradable layers are worn off during the start-up, the vane play is again increased by the expansion of the housing and is not necessarily optimal during steady state operation.

In addition, heat shield segments of this type and their individual attachment on the housing of the turbo machine only regulate the rotating vane play, while the guide vane play must be adjusted with a separate construction.

SUMMARY OF THE INVENTION

This results in the objective of the invention, which is to create a carrier for guide vanes and a heat shield segment arranged radially opposite from the rotor vane tips for a thermal turbo machine, where said carrier and heat shield segment achieve a minimal, radial play between the tips of the . . . vanes and the rotor and between the tips of the guide vanes and the heat shield segment, whereby this minimal vane play should be maintained in as many operating conditions as possible. In particular, damage caused by material from abradable layers should be avoided. The production costs and life span of the components hereby should be at least maintained at the current or reduced level. The seal between the heat shield segment and housing also should be improved.

A thermal turbo machine with a rotor, rotor vanes, a stationary housing, and guide vanes is provided with a guide vane carrier that is attached to the housing of the turbo machine. The guide vane carrier is provided with a guide vane platform, to which are attached one or more guide vane airfoils. Heat shield segments are arranged radially opposite from the tips of the rotor vanes. According to the invention, an entire, axially adjoining heat shield segment or a part of two axially adjoining heat shield segments are part of the guide vane platform. Also, at least two braces extend at an angle to the guide vane platform, in part radially outward, towards a band. The braces hereby each extend in different directions relative to each other, in the manner of open scissors, from the guide vane platform towards the band. The radially outer ends of the braces are connected by the band, whereby the band is attached to the stationary housing. Furthermore, the guide vane platforms as well as the braces are made, in particular, from a first material with a high coefficient of expansion, whereby the band consists of a second material with a coefficient of expansion that is lower in comparison to the first material.

By integrating guide vane platform and heat shield segment, both the radial play between the guide vane tip and rotor, as well as the one between the rotating vane tip and the heat shield segment are simultaneously determined by a single construction. As a result of material choice for the band on the one hand and for the braces and integrated guide vane platform on the other hand, the guide vane carrier with the heat shield segment exhibits a thermal behavior that results in minimal vane play during the various operating conditions of the turbo machine. Since the coefficient of expansion of the band is lower than that of the material of the braces and guide vane platform, the band expands less quickly than the braces. During the warming of the machine, the angled arrangement of the braces causes a scissors-like movement, so that the guide vane platform moves radially inward along with the heat shield segment. After the machine start-up has completed and during the steady state operation, this results in minimum vane play, and thus an improved efficiency of the turbine or compressor. During the machine shut-down, the expansion of the band and braces again changes at different rates so that the braces move similar to a movement during the opening of scissors, and the guide vane and heat shield segment move away from the rotor and prevent a brushing against the vane tips.

Compared to turbo machines according to the state of the art, the guide vane carrier with heat shield segment according to the invention achieves reduced vane play without using abradable layers, thus preventing damage due to worn-off material.

The integration of guide vane platform and heat shield segment furthermore eliminates a sealing point in each guide vane platform, which in the case of a two-part construction for heat shield segment and guide vane platform would be created between these two parts. In the turbo machine according to the invention, the number of sealing points is also greatly reduced, which again benefits performance.

The guide vane carrier with integrated heat shield segment according to the invention furthermore has the advantage of a more stable construction. Because of the lower number of components required, a simplified suspension on the stationary housing that requires less space is also possible. This also results in reduced costs.

According to the invention, the heat shield segment is part of the guide vane platform. The guide vane platform is hereby constructed as a single component with the heat shield segment, or, in a second case, the guide vane platform is constructed as a single component together with a carrier for the heat shield segment. In the latter case, the heat shield segment is attached to a carrier. In the embodiments of the invention described below, the guide vane platform integrated with the heat shield segment in each case refers to both of these cases.

In a first embodiment, each of three braces extend from the guide vane platform integrated with the heat shield segment towards the band, whereby the center brace of the three braces extends at a first angle towards the band, and the two exterior braces extend parallel to each other, at an angle, in the opposite direction to the center brace towards the band, so that the bands form a V-or X-shaped arrangement.

In a second embodiment, two braces extend from the guide vane platform towards the band, whereby each of these are arranged at an angle to the platform, so as to form a scissors-like X-shaped or V-shaped arrangement.

In a variation of these two embodiments, the braces extend from the guide vane platform in a scissors-like arrangement, by leading at an angle from the guide vane platform in part axially, in part radially outward towards the band. The "open scissors" therefore are located in a plane parallel to the rotor axis or in a plane leading through the rotor axis.

In a variation, the braces and the band are constructed continuously in circumferential direction over the length of the guide vane platform.

In order to thermally stress relieve the guide vane carrier, the braces in another variation are constructed with arc-shaped cut-outs. For further thermal relief, the braces in a preferred variation are arranged together with the band arranged above them in the circumferential direction on the guide vane platform in several individual sections.

In another variation, each of the braces extends from the guide vane platform at an angle in part in circumferential direction, in part radially outward in a scissors-like arrangement towards the band. The "open scissors" thus are in a plane vertical to the rotor axis.

In another variation, the joint between axially adjoining guide vane platforms with integrated heat shield segments is arranged according to the pressure distribution in the area of the rotating vane tip in such a way that a leakage flow through the joint is minimized.

The guide vane carrier with its integrated heat shield segment is in each case integrated in one or more recesses in the stationary housing of the turbo machine.

To further reduce leakages at the joints between integrated guide vane platforms, the guide vane platforms with the integrated heat shield segments of one guide vane row are arranged offset in relation to the integrated guide vane platforms of an adjoining guide vane row. This prevents the joints between two circumferentially adjoining guide vane platforms with joints from coinciding with the joints between two consecutive, integrated guide vane platforms of the next guide vane row. This creates a sort of labyrinth for the leakage flow, and the leakage flow is therefore reduced.

The leakage points in circumferential and axial direction are hereby further sealed with sealing elements of various types.

Finally, the space bordered by the guide vane platform with heat shield segment, the braces, and the band is in each case filled with air or a filler.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings.

DETAILED DESCRIPTION OF THE INVENTION

Figure 1A:
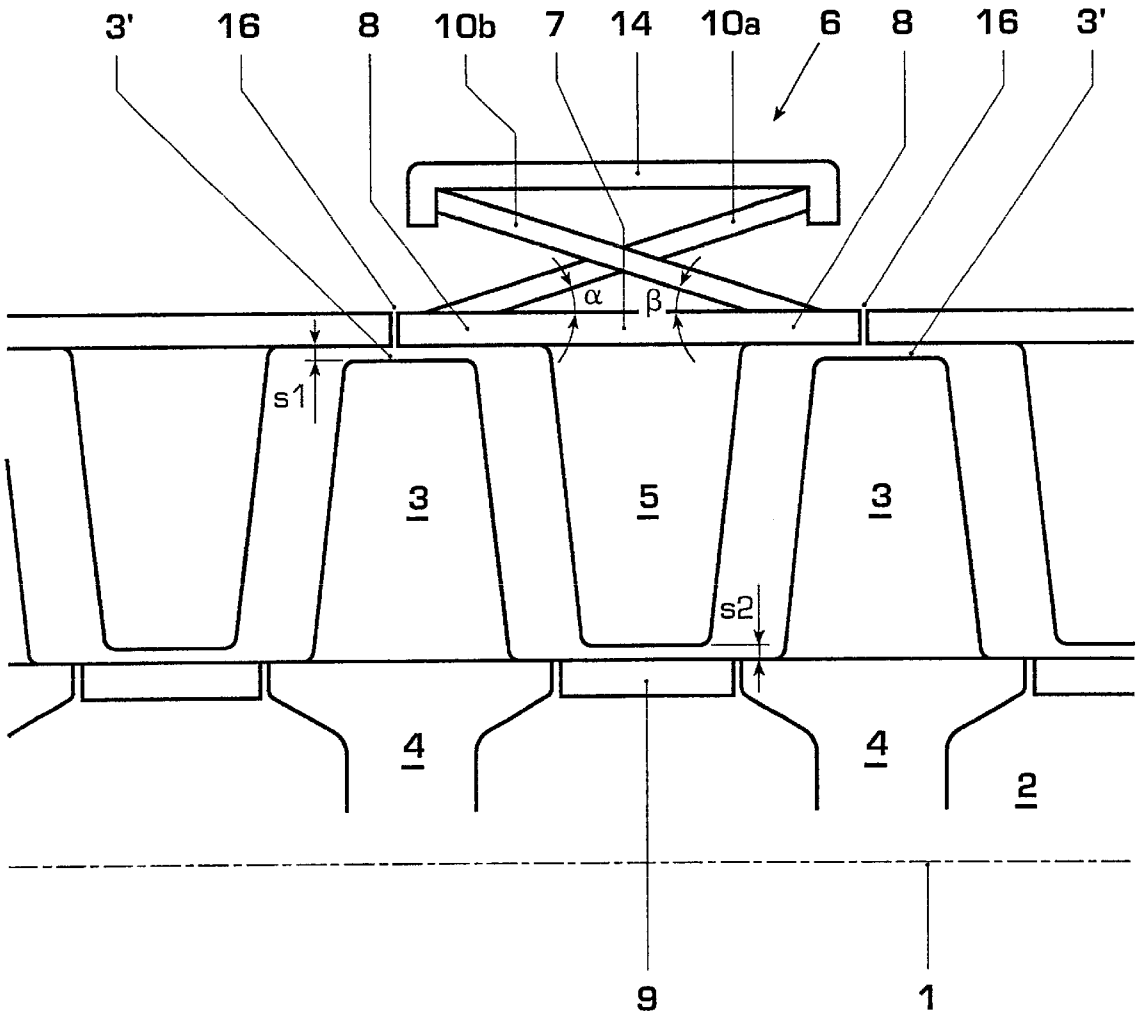
FIG. 1*a* shows a section through a thermal turbo machine in a meridian plane with an embodiment of the guide vane carrier with integrated heat shield segment according to the invention, in which the braces extend in part axially, in part radially from the guide vane platform.

FIG. 1*a* shows a turbine in a section along axis 1 of its rotor 2. Rotating vanes 3 are attached via carriers 4 attached to the rotor 2. Guide vanes 5 are attached with one of each guide vane carrier 6 according to the invention to the stationary housing. A guide vane carrier 6 has a guide vane platform 7 that extends axially over the width of the guide vane 5 and beyond it. In the shown embodiment, the guide vane platform 7 extends over part of the width of the adjoining rotating vane tip 3', whereby it functions as a heat shield segment 8 in the area of the rotating vane tip 3'. The heat shield segments 8 are hereby part of the guide vane platform 7. In the shown embodiment, the guide vane platform is itself integrated with the heat shield segment to form a single component.

In a further embodiment (not shown here), the heat shield segment is attached to a carrier. The guide vane platform is integrated with the carrier for the heat shield segment to form a single component. The heat shield segment along with its carrier is also part of the guide vane platform. The guide vane platform may be hereby again integrated with the entire, axially adjoining carrier for the heat shield segment or with part of both axially adjoining carriers. In the case of thermal expansion of the guide vane carrier and a movement of the guide vane platform, the carrier moves simultaneously with the heat shield segment attached to it.

Figure 1B:
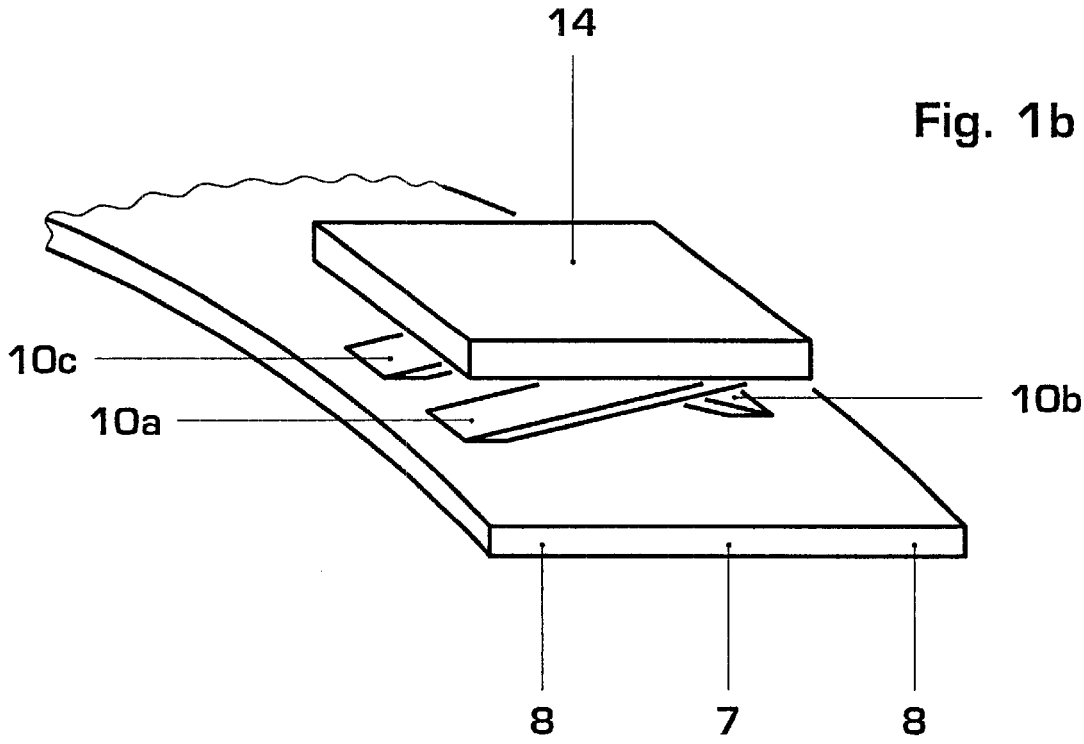
FIG. 1*b* shows a view of the guide vane carrier according to the invention with three braces extending towards the band.
Figure 1C:
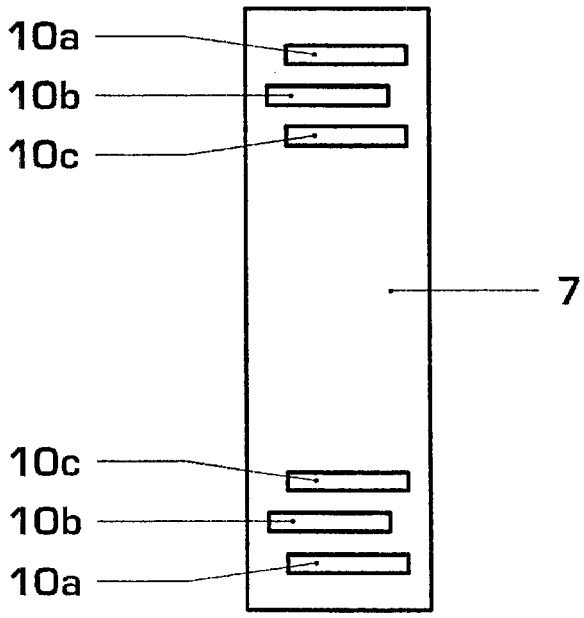
FIG. 1*c* shows a view from the top of an arrangement of braces on the guide vane platform, whereby three braces are in each case arranged in a group.

A vane play s1 exists between the heat shield segment 8 and vane tip 3'. In a similar manner, a vane play s2 exists between the guide vane tip 5' and a heat shield segment 9 attached radially opposite from the guide vane tip 5' on the rotor 2. As seen in FIGS. 1*a* and 1*b*, three braces 10*a*, 10*b*, 10*c* extend from the guide vane platform 8 in part radially, in part axially towards a band 14. They are connected towards the band 14 that extends approximately over the entire width of the guide vane platform 7. The brace 10*a* extends from the area of one side of platform 7 at an angle towards band 14. Brace 10*c* extends parallel and at an interval to brace 10*a* also towards band 14. The third brace 10*b* extends from the opposite side of the platform 7 at an angle between the braces 10*a* and 10*c* towards band 14. In the shown view, braces 10*a* and 10*c* cross brace 10*b* between platform 7 and band 14, but do not touch each other, since they are arranged, as in FIG. 1*c*, from the top (without band). Here two groups of three braces 10*a, b, c* each are shown. It is also possible that several units of braces are arranged on a platform 7 with the band.

The band 14 consists of a material with low coefficients of expansion, while the braces 10*a–c* and the guide vane platform 7 with the heat shield segment 8 consist of a material with higher coefficients of expansion. The construction of the guide vane carrier 6 with its scissors-like arrangement of the braces 10*a–c* on the one hand, and the use of materials with different thermal expansion of band 14 and braces 10*a–c* with the guide vane platform 7 on the other hand bring about a distinct thermal behavior that results in a greater expansion of braces 10*a–c* than band 14 when the turbine or compressor are heated, for example when the machine is started. Since the braces 10*a–c* expand more than the band 14, the angles between the guide vane platform 7 and braces 10*a–c* are slightly increased during the heating. The guide vane 5 moves along with the heat shield segment 8 radially inward towards rotor 2. This causes a reduction of both vane play s2 and vane play s1.

The axial extension of the guide vane platform 7 with integrated heat shield segment 8 according to the invention and the positioning of the axial joints between axially adjoining guide vane platforms is preferably determined according to the pressure distribution over the rotating vane tip 3'. More precisely, the extension of the platform 7 is determined in such a way and the joint 16 between axially adjoining guide vane platforms is positioned in such a way that leakage flows at the joints 16 are minimized.

Figure 2A:
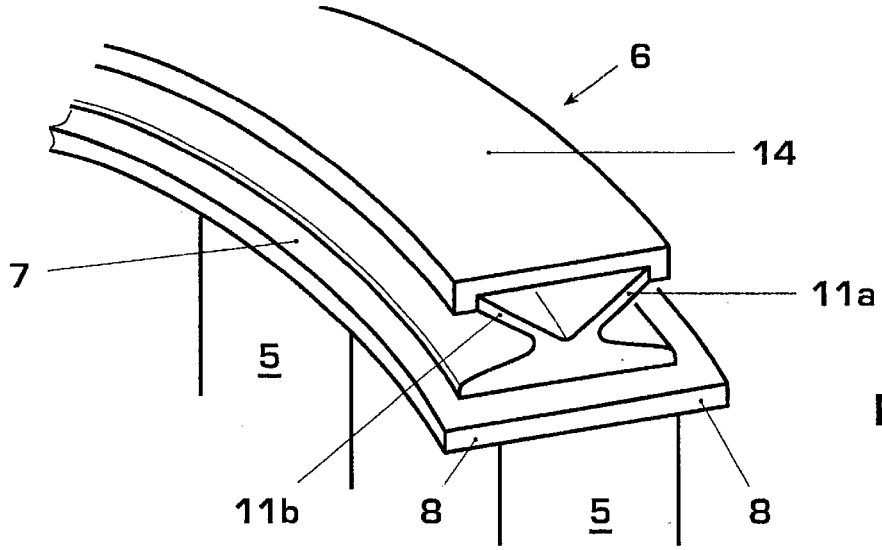
FIG. 2*a* shows a view of a guide vane carrier with two braces that are constructed continuously in circumferential direction.

FIG. 2*a* shows a view of a variation of the guide vane carrier 6 according to the invention. Several guide vanes 5 can be attached to a guide vane platform 7, of which only two guide vanes 5 are shown here. On both sides of guide vanes 5, the heat shield segments 8 are integrated with the guide vane platform 7. Braces 11*a* and 11*b* again extend from the guide vane platform 7 towards band 14. In spite of three crossed braces, two braces are here arranged in a V shape, whereby the V extends in an axial direction. The band 14 again consists of a material with a coefficient of expansion that is smaller than the coefficient of expansion of the material for the braces and the guide vane platform.

In the variation shown in FIG. 2*a*, braces 11*a* and 11*b* and band 14 are constructed continuously in circumferential direction over the length of the guide vane platform.

Figure 2B:
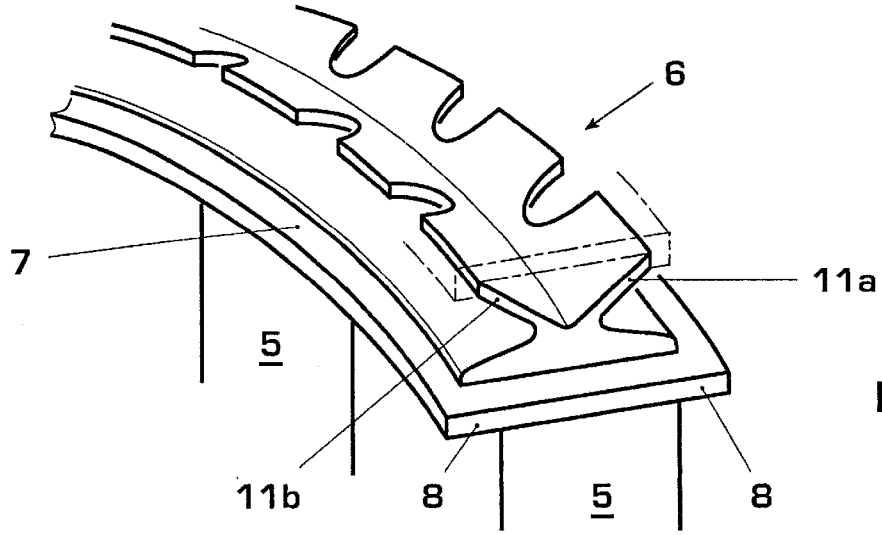
FIG. 2*b* shows a view of a guide vane carrier according to the invention with two braces provided with arc-shaped cut-outs in circumferential direction.

FIG. 2*b* shows a further variation, in which the braces are provided with several arc-shaped recesses 21 in circumferential direction. Because of the reduction in material, the thermal load on the guide vane carrier is reduced.

Figure 2C:
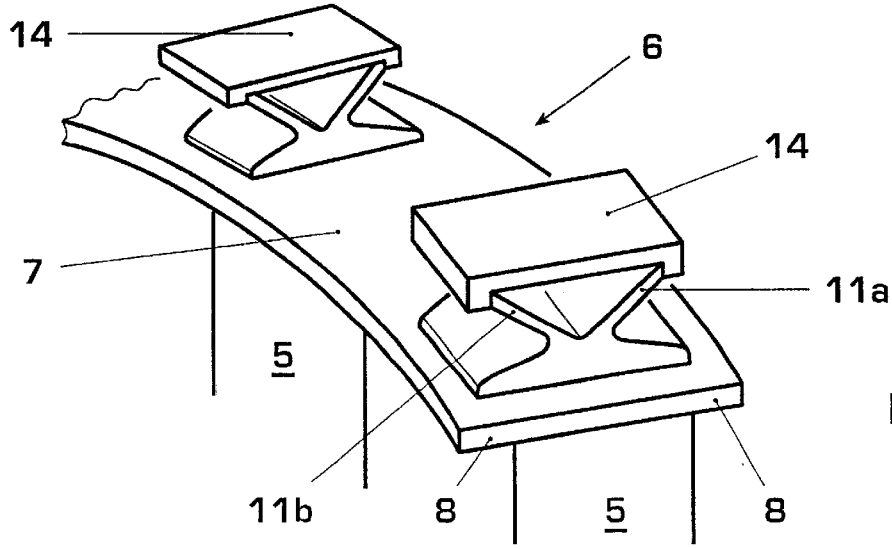
FIG. 2*c* shows a view of a guide vane carrier according to the invention with two braces, whereby the braces are arranged in circumferential direction with bands in individual sections.

In order to further reduce the thermal load, the braces and the band above them are arranged in several sections 22 in circumferential direction in FIG. 2*c*.

Figure 3A:
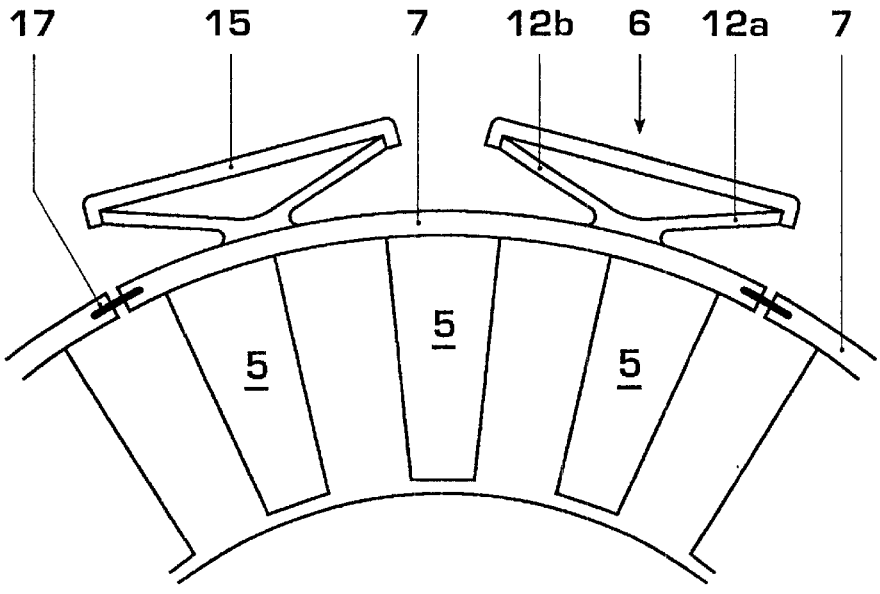
FIG. 3*a* shows a section through the thermal turbo machine in a plane vertically to the meridian plane with an embodiment of the guide vane carrier with integrated heat shield segments according to the invention, in which the braces extend in part radially, in part circumferentially from the guide vane platform.
Figure 3B:
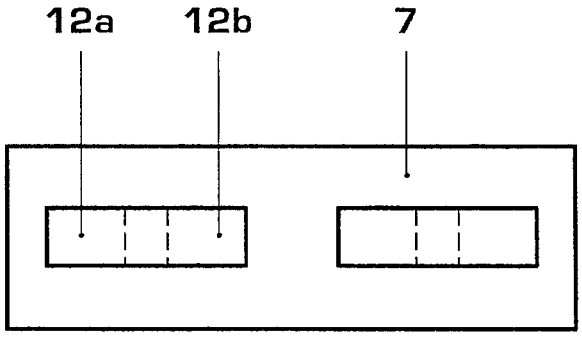
FIG. 3*b* shows a view from the top of a portrayal of the arrangement of groups of two braces according to FIG. 3.
Figure 3C:
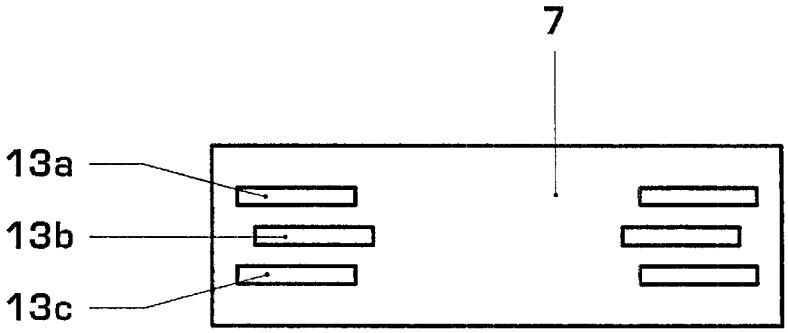
FIG. 3*c* shows a view from the top of another portrayal of groups of three each braces that extend in part radially, in part circumferentially.

Compared to the variation in FIGS. 2*a–c*, the V-shaped constructions of the braces and bands in FIGS. 3*a* and 3*b* are rotated by 90°, so that the V in each case extends in a circumferential direction. Because of the different thermal behavior of braces 12*a* and 12*b* on the one hand, and bands 15 on the other hand, this orientation also results in a radially inward movement of the guide vane platform 7 with guide vanes 5 and heat shield segments 8 when the temperatures rise. The joints 16 between the guide vane platforms 7 adjoining each other circumferentially are in each case sealed with a sealing element 17 that is inserted into a groove in the guide vane platform 7. FIG. 3*b* shows the arrangement of the V-shaped braces on the guide vane platform 7. FIG. 3*c* shows a further arrangement of braces 13*a, b*, and *c*, whereby, similar to FIGS. 1*a* and 1*b*, the three braces 13*a, b*, and *c* extend towards a band, and braces 13*a–c* are arranged in X shape or crossed. Contrary to FIGS. 1*a* and 1*b*, the X here extends circumferentially.

In the embodiments described here, braces 10*a,b,c*, 11*a,b*, 12*a,b*, 13*a,b,c* can be connected in different ways with the band, for example by welding, soldering, suspending or clamping. The braces hereby also can be shaped round at their exterior ends, whereby the band has a shape corresponding to the brace.

Figure 4:
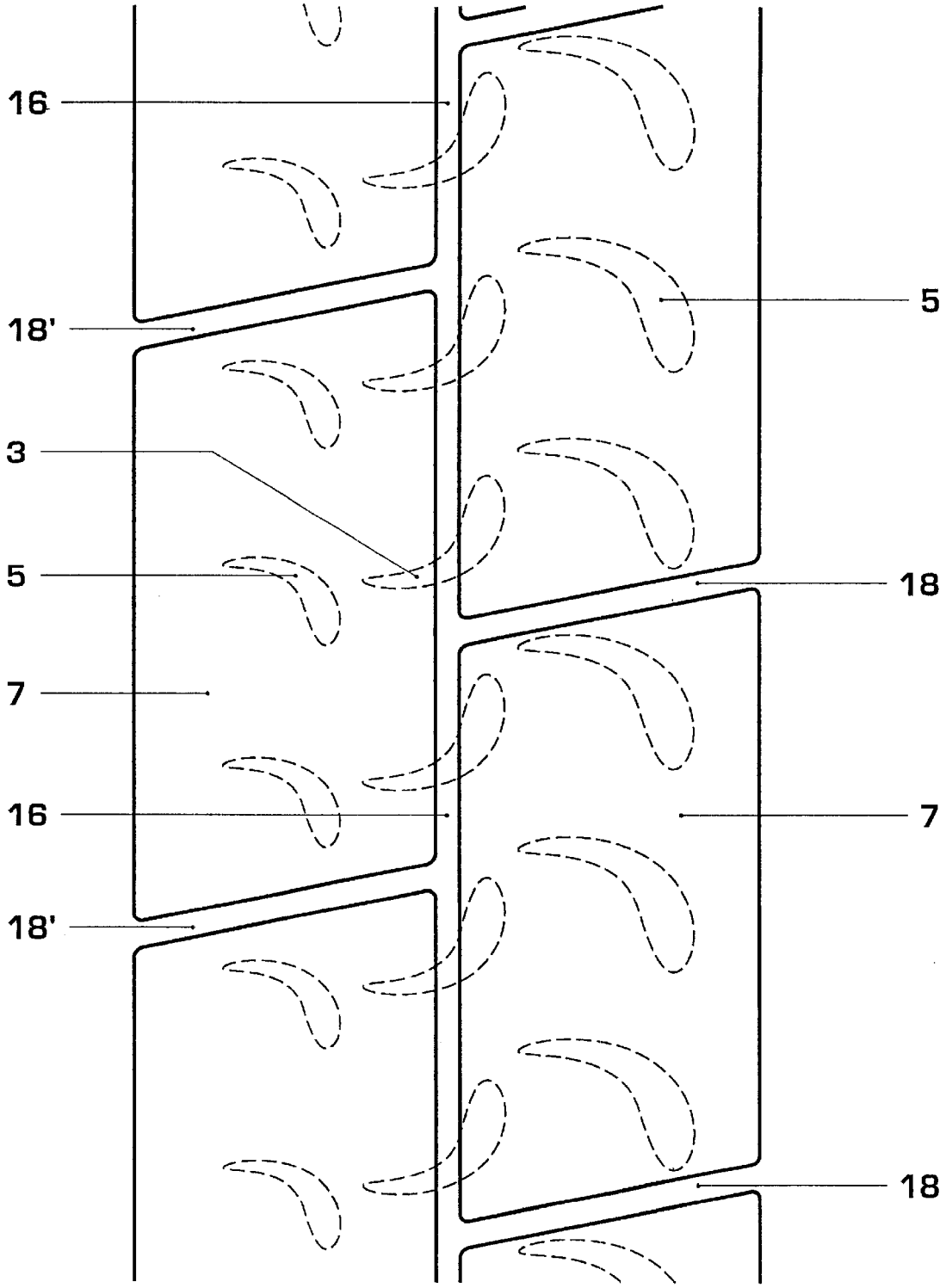
FIG. 4 shows a portrayal of the arrangement of the guide vane platforms of adjoining guide vane carriers according to the invention.

FIG. 4 shows an arrangement of adjoining guide vane carriers in an axial direction and circumferential direction. Only the guide vane platforms 7 with integrated heat shield segments and the rows of rotating and guide vanes 3 and 5 below them are shown here. Joints 18 are located between the guide vane platforms 7 for a first row of guide vanes 5 and the guide vane platforms 7 of a row of guide vanes 5 adjoining them in circumferential direction. Accordingly, one joint 18' exists between the guide vane platforms 7 for a second row of guide vanes 5 that are adjoining them in a circumferential direction. A joint 16 exists between the axially adjoining guide vane platforms 7. In the shown variation of the guide vane carriers according to the invention, the guide vane platforms 7 are arranged so that the joints 18 are arranged offset in relation to the joints 18'. This brings about the reduction of leakage flows at joints 18 and 18' by creating a sort of labyrinth.

Figure 5:
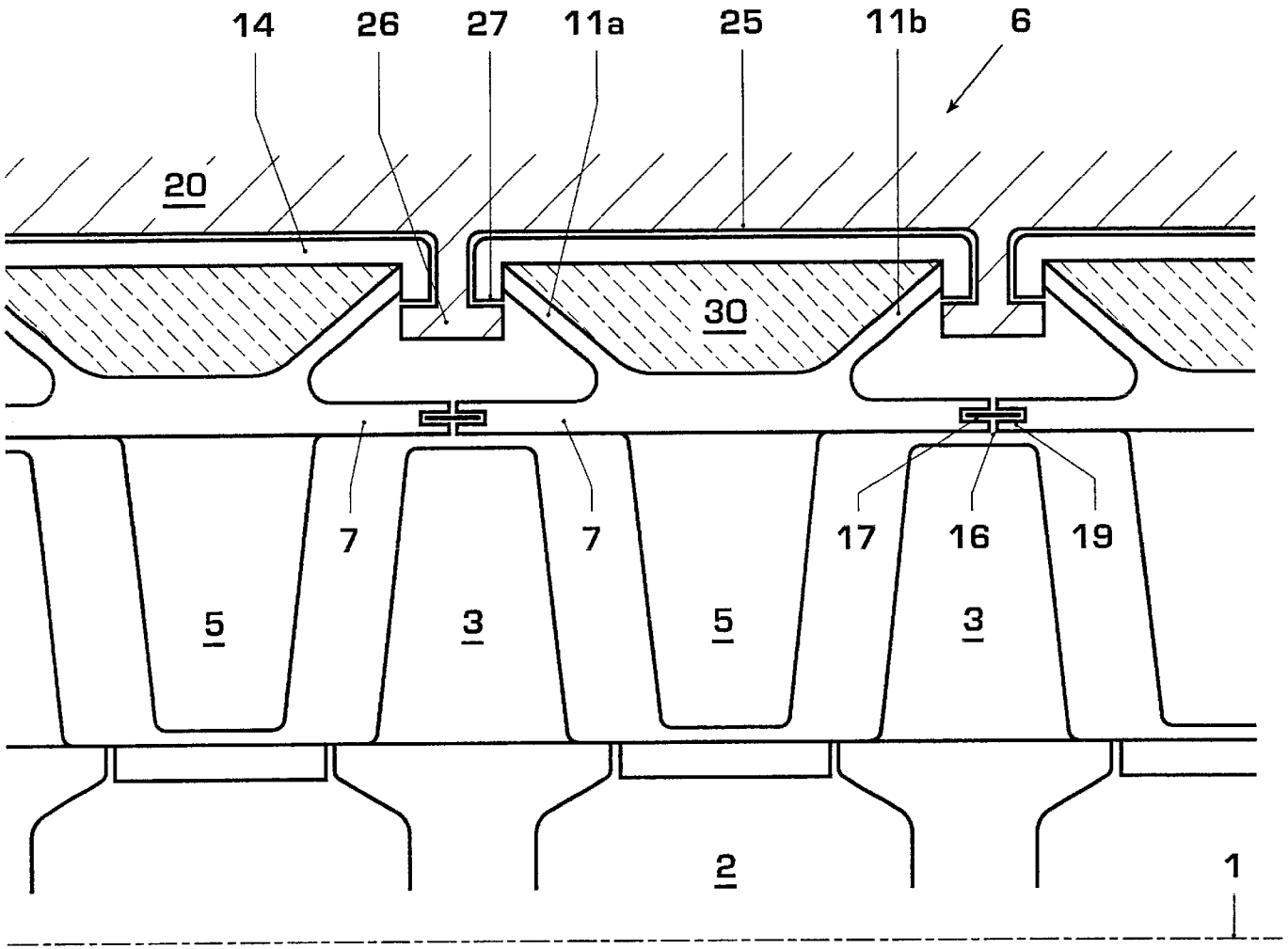
FIG. 5 shows a guide vane carrier according to the invention and its attachment to the stationary housing of the turbine or compressor.

FIG. 5 shows a guide vane carrier 6 according to the invention and its attachment on a stationary turbomachine housing 20. The housing 20 is provided with recesses 25 with T-shaped rails 26, into each of which is inserted the band 14 of a guide vane carrier 6, whereby one shoulder 27 on the band 14 is adapted to the T-shaped rails 26.

The braces 11*a* and 11*b* are here V-shaped and arranged relatively widely spaced apart, and the band 14 has a corresponding width by extending almost over the entire width of the guide vane platform 7. The positioning of the braces on the guide vane platform, for example somewhat apart, as in FIG. 5, or close together, such as in FIGS. 6*a* and *b*, makes it possible to adjust the radial movement of the guide vane carrier.

The space 30 between the braces 11*a* and 11*b*, here arranged in a V-shape, and the band 14 above them is either filled with air or, for insulation purposes, with a filler.

Figure 6A:
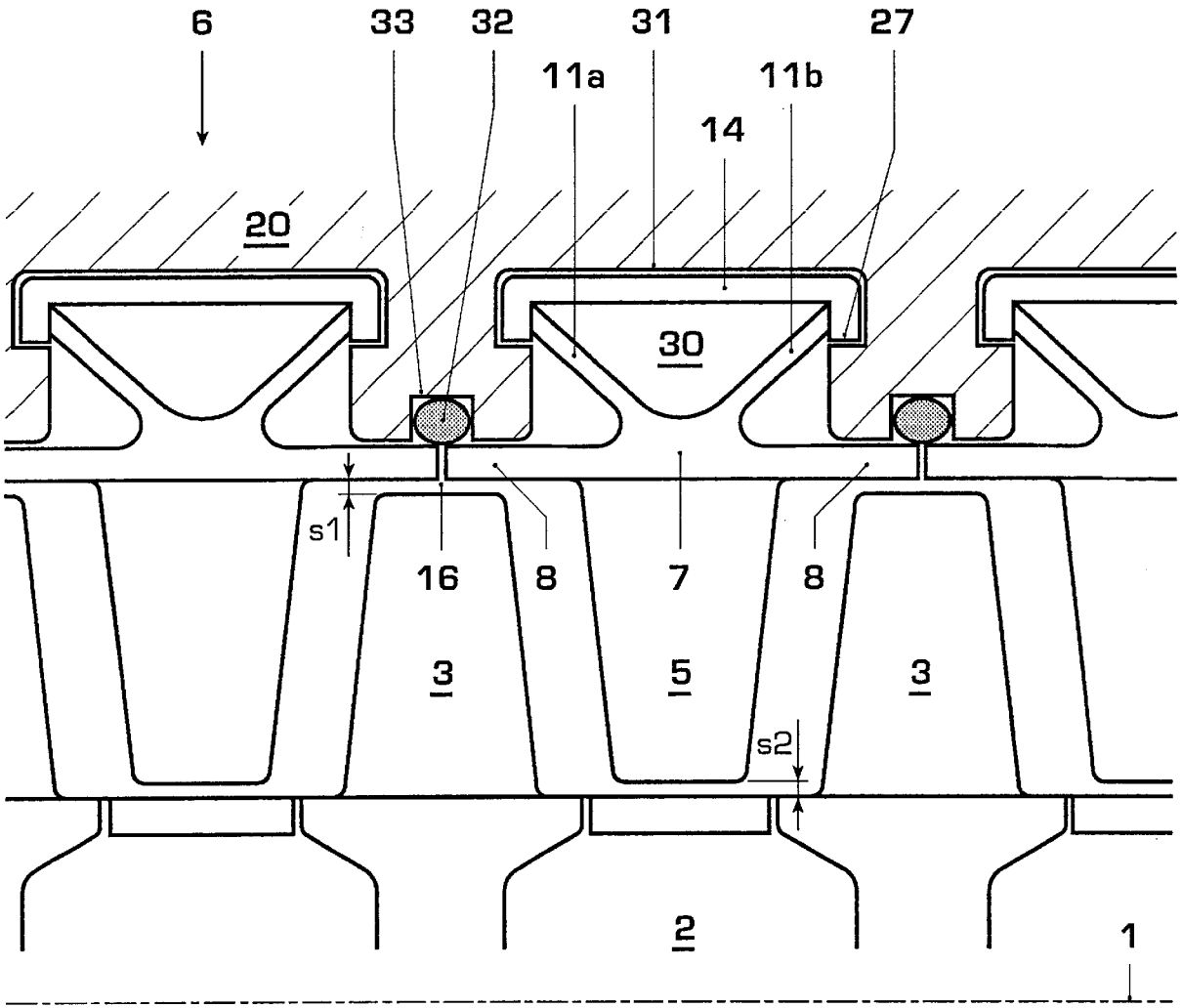
FIGS. 6*a* and 6*b* show further variations of the guide vane carrier according to the invention with various attachments to the stationary housing of the turbo machine.

The joints 16 between axially adjoining guide vane platforms 7 are also sealed here with sealing elements 17 which have been inserted in a groove 19 in platform 7. 6 FIG. 6*a* shows a variation of an attachment of the guide vane carrier 6 on the stationary housing 20. The housing 20 here has a similar recess 31 as in FIG. 5, into which recess the band 14 of the guide vane carrier 6 is inserted, whereby a shoulder 27 on the band 14 is adapted to the recess 31. The joint 16 between axially adjoining guide vane platforms 7 with integrated heat shield segment 8 is sealed by a part of the housing 20 and a seal 32, for example an O ring 32 that is inserted into a groove 33 in the housing 20. The braces 11*a* and 11*b* are again V-shaped here, but arranged closer to each other, whereby the band 14 above them extends over a smaller part of the width of the guide vane carrier 6.

Figure 6B:
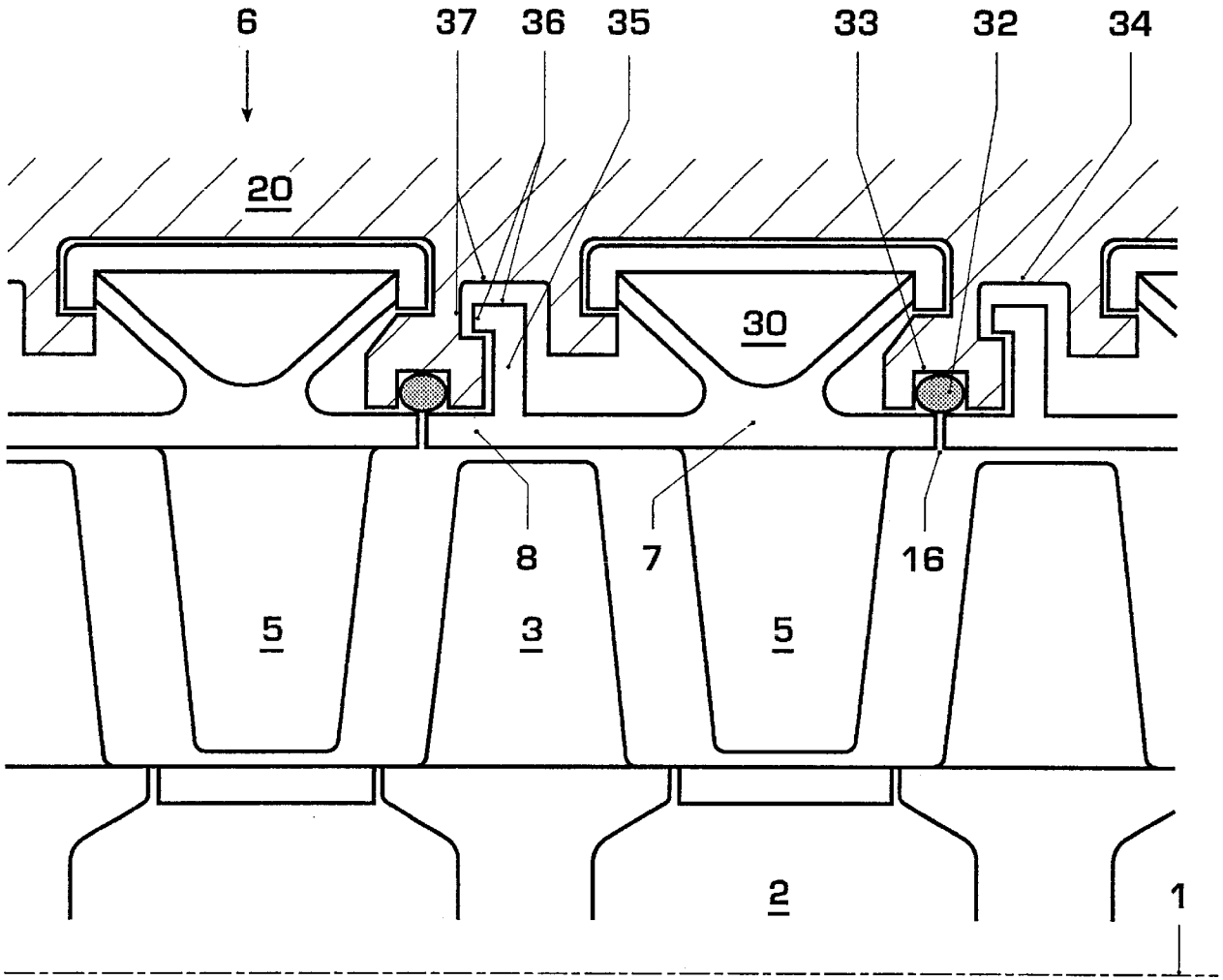

FIG. 6*b* shows another variation of a guide vane carrier 6 according to the invention, whose heat shield segment 8 is integrated only on one side of the guide vane platform 7, but extends over the complete width of the adjoining rotating vane. The joint 16 is also located between the rows of guide and rotating vanes 5 and 3 here.

To attach the guide vane carrier 6 that is constructed asymmetrically in relation to the guide vane 5, the housing 20 has an additional recess 34, into which a holder 35 is inserted at the guide vane platform 7. A free space that permits axial and radial movements of the guide vane carrier 6 exists between the end surfaces 36 of the holder 35 and the side walls 37 of the additional recess 34. The joints 16 between axially adjoining guide vane platforms 7 are again sealed by O rings 32 inserted into grooves 33, whereby other sealing elements also can be realized.

In all variations of the guide vane carrier according to the invention, the braces are connected in different ways with the guide vane platform. As a first option, the braces are produced relatively simply together with the guide vane platform by using a casting process. As a second option, the braces are connected by means of a joint with the guide vane platform.

Although this invention has been illustrated and described in accordance with certain preferred embodiments, it is recognized that the scope of this invention is to be determined by the following claims.

What is claimed is:

1. A thermal turbo machine comprising:

a rotor, a stationary housing, rotating vanes attached to the rotor, said rotating vanes having tips, heat shield (a) segments arranged radially opposite from the tips of the rotating vanes, and guide vanes attached by guide vane carriers to the stationary housing, whereby the guide vane carriers each have a guide vane platform;

said heat shield segments that at least partly axially adjoin the guide vane on both sides, being part of the guide vane platform;

at least two braces extending in part radially outward from the guide vane platform, whereby the braces extend from the guide vane platform in the manner of open scissors towards a band, and radially outer ends of said at least two braces being connected by the band, said band being attached to the housing of the turbo machine; and the guide vane platform and braces including a first material, and the band comprising a second material that is different from the first material, wherein the coefficient of expansion of the first material is greater than the coefficient of expansion of the second material.

2. The thermal turbo machine as claimed in claim 1, wherein the guide vane platform is constructed as a single component with the axially adjoining heat shield segments.

3. The thermal turbo machine as claimed in claim 2, wherein three braces extend from the guide vane platform having said integrated heat shield segments, wherein said three braces extend in part axially, in part radially outward from the guide vane platform toward the band, whereby the center one of the three braces is arranged at a first angle to the guide vane platform, and the two outer braces extend parallel to each other at an angle relative to the center brace, in axially opposite direction, towards said band, and the three braces together form a scissors-like V or X shape.

4. The thermal turbo machine as claimed in claim 2, wherein two braces extend from the guide vane platform having said integrated heat shield segment, each of said braces extend in part axially, in part radially outward and each of said braces extending at an angle from the guide vane platform towards the band, wherein the two braces extend in axially opposite direction from each other towards the band and form a scissors-like V or X shape.

5. The thermal turbo machine as claimed in claim 4, wherein the braces and the band are constructed continuously in a circumferential direction over the length of the guide vane platform.

6. The thermal turbo machine as claimed in claim 5, wherein the braces are provided with arc-shaped cut-outs in the circumferential direction over the length of the guide vane platform.

7. The thermal turbo machine as claimed in claim 4, wherein the braces and the band are arranged in a circumferential direction over the length of the guide vane platform in several individual sections.

8. The thermal turbo machine as claimed in claim 2, wherein the braces extend from the guide vane platform in part in a circumferential direction, in part radially outward towards the band.

9. The thermal turbo machine as claimed in claim 1, wherein the guide vane platform is constructed as a single component with a carrier for the heat shield segments axially adjoining the guide vane, said axially adjoining heat shield segments being attached to the carrier.

10. The thermal turbo machine as claimed in claim 1, wherein the joint between axially adjoining guide vane platforms, with said integrated heat shield segments, is arranged according to the pressure distribution in the area of the rotating vane tips in such a way that a leakage flow through the joint is minimized.

11. The thermal turbo machine as claimed in claim 1, wherein the guide vane carrier, with said guide vane platform having integrated heat shield segments, is attached to the stationary housing of the turbo machine by arranging the band in recesses in the stationary housing.

12. The thermal turbo machine as claimed in claim 1, wherein joints between said guide vane platforms for a first row of guide vanes, said guide platforms adjoining each other in circumferential direction, are arranged offset relative to the joints between the guide vane platforms for a second row of guide vanes, said guide vane platforms adjoining each other in a circumferential direction.

13. The thermal turbo machine as claimed in claim 1, wherein the joints between guide vane platforms are sealed with sealing elements.

14. The thermal turbo machine as claimed in claim 1, wherein the space between the braces that are arranged in V shape and the connecting band are filled with a filling material.

15. The thermal turbo machine as claimed in claim 1, wherein the braces and the guide vane platform are connected with each other by being cast as a single part.

16. The thermal turbo machine as claimed in claim 1, wherein the braces and the guide vane platform are connected with each other with articulations.

17. The thermal turbo machine as claimed in claim 1, wherein the guide vane platform is constructed as a single component with part of both said axially adjoining heat shield segments.

18. The thermal turbo machine as claimed in claim 1, wherein the guide vane platform is constructed as a single component with the carriers for each part of both heat shield segments that axially adjoin the guide vane, and the parts of the axially adjoining heat shield segments are attached to said carriers.

19. A thermal turbo machine comprising a rotor having vanes attached to the rotor, the vanes having tips, a stationary housing surrounding the rotor and vanes, guide vanes attached by guide vane carriers to the stationary housing, the guide vane carriers each having a guide vane platform, the guide vane platform including heat shield segments, a band on the stationary housing opposite the guide vane platform, braces extending between the guide vane platform and the band, the guide vane platform and the braces being formed of a first material and the band being formed of a second material, the coefficient of expansion of the first material being greater than the coefficient of expansion of the second material.

20. The thermal turbo machine as claimed in claim 19, wherein the guide vane platform is constructed as a single component with said heat shield segments.

21. The thermal turbo machine as claimed in claim 20, wherein three braces extend from the guide vane platform having said integrated heat shield segments, wherein said three braces extend in part axially, in part radially outward from the guide vane platform towards the band, whereby the center one of the three braces is arranged at a first angle to the guide vane platform, and the two outer braces extend parallel to each other at an angle relative to the center brace, in an axially opposite direction, towards said band, and the three braces together form a scissors-like V or X shape.

22. The thermal turbo machine as claimed in claim 20, wherein two braces extend from the guide vane platform having said integrated heat shield segments, each of said braces extending in part axially, in part radially outward and each of said braces extending at an angle from the guide vane platform towards the band, wherein the two braces extend in axially opposite direction from each other towards the band and form a scissors-like V or X shape.

23. The thermal Turbo machine as claimed in claim 22, wherein the braces and the band are constructed continuously in a circumferential direction over the length of the guide vane platform.

24. The thermal turbo machine as claimed in claim 19, wherein the guide vane platform is constructed as a single component with a carrier for the heat shield segments which axially adjoin the guide vane, said axially adjoining heat shield segments attached to the carrier.

* * * * *